US005425288A

United States Patent [19]

Evans

[11] Patent Number: 5,425,288

[45] Date of Patent: Jun. 20, 1995

[54] MANUFACTURE OF ROTARY DRILL BITS

[75] Inventor: Stephen M. Evans, Hardwicke, England

[73] Assignee: Camco Drilling Group Ltd.

[21] Appl. No.: 249,260

[22] Filed: May 25, 1994

[30] Foreign Application Priority Data

Jun. 3, 1993 [GB] United Kingdom ..... 9311444

[51] Int. Cl.[6] ..... B23P 15/00; B21K 5/00

[52] U.S. Cl. ..... 76/108.2; 76/DIG. 1; 76/DIG. 12; 175/434

[58] Field of Search ..... 76/108.1, 108.2, 108.4, 76/DIG. 11, DIG. 12, 101.1; 299/90; 164/54; 29/458, 527.6; 175/57, 420.2, 434

[56] References Cited

U.S. PATENT DOCUMENTS 4,499,795 2/1985 Radtke ..... 76/DIG. 12
4,593,776 6/1986 Salesky et al. ..... 76/108.2 X
4,761,191 8/1988 Keller et al. ..... 76/108.2 X
4,762,028 8/1988 Regan ..... 76/108.2

*Primary Examiner*—Douglas D. Watts

[57] ABSTRACT

A method of manufacturing a rotary drill bit includes the steps of forming the bit body with a plurality of sockets, inserting in each socket a projecting carbon former, applying a fusible hard facing material to the surface of the bit body, and around the formers, by the localised application of heat to the solid material so as to melt it and weld it to the surface of the bit body, and then replacing the formers with cutters. During the application of the hard facing material, each former is also heated by the application of heat directly to it, so as to raise the temperature of the former to a level greater than the temperature to which it would otherwise be raised solely by conduction of heat from the hard facing material. This increases the tendency for the molten material to wet the surface of the former so that the resulting aperture in the hard facing material, once the former has been removed, is accurately sized to the dimensions of the former and hence of the cutter which is subsequently to be inserted in the socket.

9 Claims, 3 Drawing Sheets

MANUFACTURE OF ROTARY DRILL BITS

BACKGROUND OF THE INVENTION

The invention relates to the manufacture of rotary drill bits for use in drilling or coring holes in subsurface formations.

The invention may be applied to any rotary drill bit of the kind having cutting inserts mounted in sockets in a part of the bit body. However, the invention is particularly applicable to drag-type rotary drill bits of the kind comprising a bit body having a shank for connection to a drill string, a plurality of cutting structures mounted in sockets in the bit body and projecting from the face of the bit, and a number of nozzles, also mounted in sockets in the bit body, and communicating with a passage for supplying fluid to the face of the bit.

Each cutting structure may comprise a cutting element mounted on a carrier, such as a stud or post, which is received in the socket in the bit body. One common form of cutting element comprises a circular tablet having a facing table of polycrystalline diamond or other superhard material and a substrate of less hard material such as cemented tungsten carbide.

Particularly in cases where the bit body is machined from steel, the surface of such a bit is susceptible to wear and erosion during use, particularly in the vicinity of the nozzles from which abrasive drilling fluid emerges at high velocity and with substantial turbulence. Accordingly, it is fairly common practice to apply a hard facing material to the surface of the bit body, at least around the cutting structures. Normally the hard facing is applied to the bit body before the cutting structures themselves are fitted into their sockets since the cutting structures would be likely to suffer thermal damage if the hard facing were to be applied after the cutting structures had been fitted.

In order to prevent the hard facing material, which is applied in a molten state, from entering the sockets, it is usual to plug the sockets temporarily with formers made of carbon material, such as graphite. The hard facing material is then applied to the surface of the bit body around the formers, usually by a welding process using a gas welding arc or oxyacetylene torch.

However, in the methods normally employed, the molten hard facing material, during the welding process, does not wet the surfaces of the carbon formers with the result that a meniscus is formed between each former and the solidified hard facing material, resulting in the formation of a depression in the hard facing material around the former, after the material has solidified. The existence of this depression may facilitate removal of the formers after the hard facing has solidified, but it means that there is then a similar depression in the hard facing material around the subsequently inserted cutting structure. The presence of this depression enhances the erosive effect of the drilling fluid flowing around the cutting structures with the result that, in practice, there is accelerated and preferential erosion of the cutting structure and hard facing material, leading to premature failure.

The present invention provides an improved method of applying hard facing material to a bit body which reduces or eliminates the formation of a depression in the hard facing around each former, and hence between the cutting structures and the hard facing, and thus reduces or eliminates the preferential erosion which can occur with the prior art methods.

SUMMARY OF THE INVENTION

According to the invention, there is provided a method of manufacturing a rotary drill bit including the steps of forming a bit body part with a plurality of sockets, inserting in each of said sockets a carbon former which substantially fills at least the mouth of the socket and projects beyond the outer surface of the bit body part, applying a fusible hard facing material to the surface of the bit body part, at least in an area surrounding each said socket, the hard facing material being applied by the localised application of heat to the material when solid so as to cause it to melt and weld to the surface of the bit body part, and then removing the formers from the sockets, the method further including the step of heating each former by the application of heat directly to the former, during the application of the hard facing material, so as to raise the temperature of the former to a level greater than the temperature to which it would otherwise be raised solely by conduction of heat from the hard facing material.

It has been found that by directly heating the formers during the application of the hard facing material, there is a greater tendency for the molten material to wet the surface of the formers. This means that the resulting aperture in the hard facing material, once the former has been removed, is accurately sized to the dimensions of the former, which correspond to the dimensions of the cutting structure which is subsequently to be inserted in the socket. As a result, when the cutting structure is inserted in its socket it fits closely to the surface of the hard facing material so that there is not provided any depression around the cutting structure in which accelerated erosion may be initiated.

In view of the close contact between the solidified hard facing material and the former, it may be necessary to destroy the former to remove it, for example by drilling it out, but the disadvantage of this is outweighed by the improved durability of the resulting drill bit.

It will be appreciated that the method according to the invention is not limited to drag-type drill bits of the kind previously referred to, but may also be used for hard facing other forms of drill bit where sockets for cutting structures are required. For example the method could be used for hard facing the roller cones of a roller cone drill bit, prior to the insertion of the cutter studs in the sockets in the roller cones.

Preferably each former is heated to a temperature between 750° C. and the melting temperature of the hard facing material. Preferably also, each former is heated to a temperature which is within 200° C. of the melting temperature of the hard facing material.

The former may conveniently be heated by intermittently applying to the former the same heat source which is used to melt the hard facing material. Such heat source may, for example, comprise a tungsten-inert gas welding arc or oxyacetylene torch.

The hard facing material may be of any of the well-known kinds which may be applied to a surface by a welding process involving the localised application of heat. Typical materials comprise very hard particles, such as tungsten carbide or chromium carbide, in an alloy matrix. For example, one such material is supplied in the form of welding rod comprising nickel tubing filled with fused tungsten carbide grains and Cr, B, and Si, for oxyacetylene application. The deposited hard facing material consists of approximately 65% fused tungsten carbide grains in a 35% Ni—Cr—B—Si alloy matrix. Other suitable forms of hard facing material will be well known to the skilled person.

In some cases the wetting of the surface of the carbon former by the molten hard facing material may cause some slight eating away of the surface of the former. In order to compensate for this, therefore, the cross-dimensions of the portion of each former which projects from its socket may be slightly greater than the corresponding dimensions of the socket itself, so as to compensate for erosion of the surface of the projecting portion by the molten hard facing material which engages it. For example, the sockets and former may be circular in cross-section, the projecting portion of the former being of slightly greater diameter than the socket.

The invention includes within its scope a drill bit when partly manufactured by the method according to the invention.

DETAILED DESCRIPTION OF THE PREFERRED EMBODIMENTS

Figure 1:
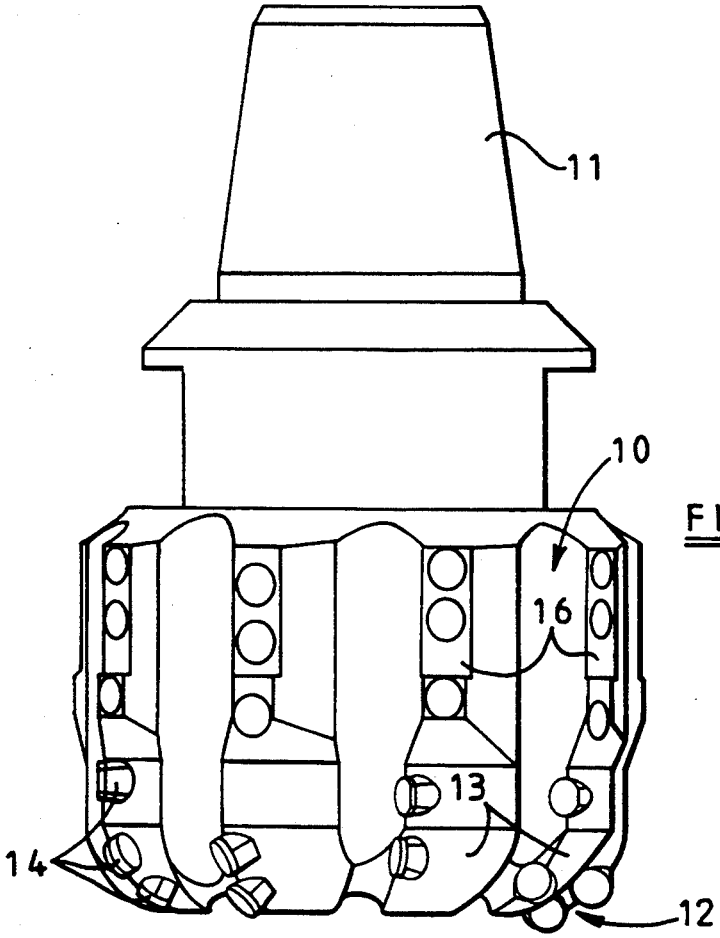
FIG. 1 is a side elevation of a typical drill bit of the kind which may be manufactured by the method according to the invention.
Figure 2:
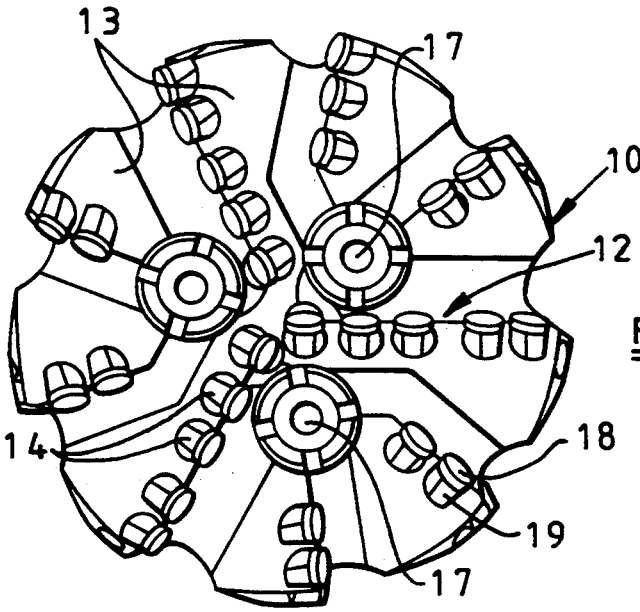
FIG. 2 is an end elevation of the drill bit shown in FIG. 1.

Referring to FIGS. 1 and 2, the bit body 10 is machined from steel, and has at one end a shank including a threaded pin 11 for connection to the drill string. The steel bit body is normally machined by computer-controlled turning and milling operations.

The operative end face 12 of the bit body is formed with a number of blades 13 radiating from the central area of the bit, and the blades carry cutting structures 14 spaced apart along the length thereof.

The bit has a gauge section including kickers 16 which contact the walls of the borehole to stabilise the bit in the borehole. In known manner abrading elements are mounted in the kickers 16. A central passage (not shown) in the bit body and shank delivers the drilling fluid through nozzles 17 in the end face 12 in known manner.

Each cutting structure 14 comprises a preform cutting element 18 mounted on a carrier 19 in the form of a stud which is secured within a socket machined into the bit body. Conventionally, each preform cutting element 18 is usually in the form of a circular tablet comprising a thin facing table of polycrystalline diamond bonded to a substrate of cemented tungsten carbide, both layers being of uniform thickness. The rear surface of the substrate of each cutting element is bonded to a suitably orientated surface on the stud, which may also be formed from cemented tungsten carbide.

It will be appreciated that this is only one example of the many possible variations of the type of bit and cutting structure to which the present invention is applicable.

Figure 3:
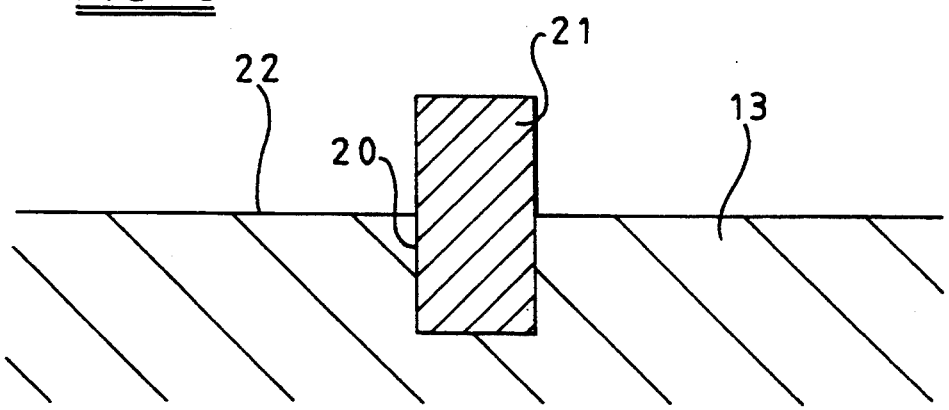
FIG. 3 is a diagrammatic section through a carbon former received in a socket in the bit body prior to hard facing.

FIG. 3 shows in section a portion of one of the blades 13 of the bit body formed with a cylindrical blind socket 20 which is ultimately to receive the stud of one of the cutting structures 14. For the purposes of applying the hard facing material to the outer surface of the blade 13, there is inserted in the socket 20 a cylindrical graphite former 21. The diameter of the former 21 is such that it is a close fit within the socket 20 and the length of the former is such that a portion thereof projects beyond the outer surface 22 of the blade.

Figure 4:
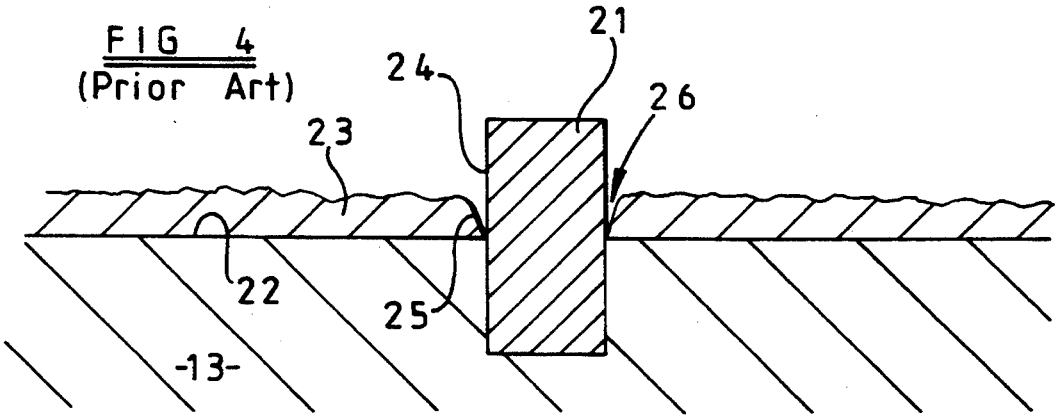
FIG 4 (Prior Art)
FIG. 4 is a similar section showing a hard facing layer applied by the method according to the prior art.
Figure 5:
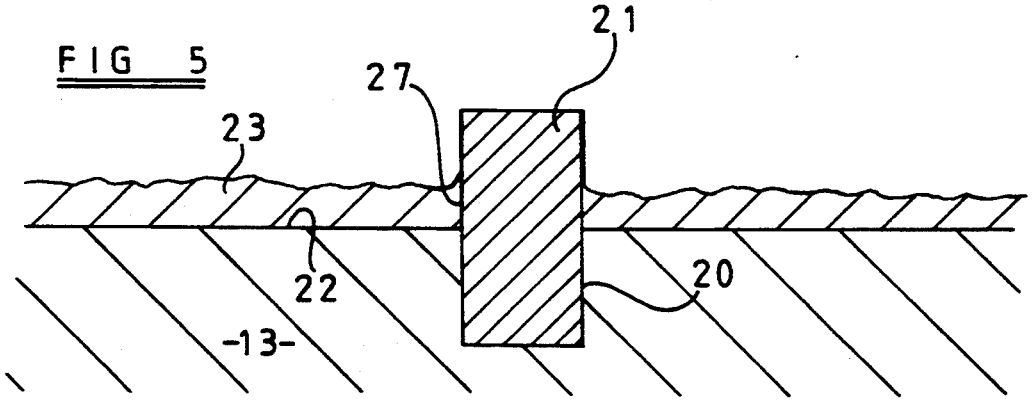
FIG. 5 is a similar view showing a hard facing material applied by the method according to the present invention.

In accordance with well known practice, there is then applied to the surface 22 of the blade 13 a hard facing material as indicated at 23 in FIG. 4. Although FIGS. 3–5 show only a single socket and former, it will be appreciated that a number of sockets and formers will normally be provided along the length of each blade 13, and these will all be surrounded by a single layer of hard facing material applied along the length of the outer surface of the blade 13.

The hard facing layer 23 may be applied, in well known manner, by a welding process using, for example, a tungsten-inert gas welding arc or an oxyacetylene torch. The hard facing material may have a melting point of about 1000° C. The precise procedures involved in applying the hard facing material to the surface of the bit are well known and will not be described in further detail.

Using the conventional welding method of the prior art, it is found that the molten hard facing material does not wet the peripheral surface 24 of the projecting surface of the former 21, but forms a meniscus 25 standing away from this surface, thus forming a depression 26 in the hard facing material surrounding the outer surface of the former 21. When the hard facing has been completed and the former 21 replaced by the cylindrical stud of a cutting structure, there will still be the depression 26 in the hard facing material around the peripheral surface of the stud. As a result of this, as previously described, there is likely to be preferential and accelerated erosion in this area around the cutting structure, leading ultimately to premature failure of the cutting structure.

In the prior art arrangement just described in relation to FIG. 4, any slight rise in temperature of the former 21 during the hard facing process is due to the conduction of heat to the former from the molten hard facing material through the bit body.

According to the present invention, the former 21 is directly heated, during application of the hard facing material, so as to raise its temperature to a much higher level, preferably above 750° C. in the case where the hard facing material melts at around 1000° C. The heating of the former 21 may be effected by intermittently applying to the former, as welding proceeds, the welding arc or oxyacetylene torch which is being used to melt the hard facing material. The colour of the graphite former 21 when heated gives an indication of its temperature and, with experience, the operator can readily ensure that the former is kept at the required elevated temperature by such intermitted heating, by observing its colour.

It is found that when the former is heated as described, the molten hard facing material 23 wets the peripheral surface of the projecting portion of the former 21, as indicated at 27 in FIG. 5. There is thus intimate contact between the hard facing material and the surface of the former and thus corresponding intimate contact between the hard facing material and the subsequently inserted stud of the cutting structure, the dimensions of which correspond to the dimensions of the former. The cutting structure will normally be brazed or shrink fitted into the socket 20. In view of the intimate contact between the hard facing material and the cutting structure, there is less tendency for preferential and accelerated erosion to be initiated around the cutting structure.

In view of the intimate contact between the hard facing material and the former 21, it may be necessary to remove the former 21 by a destructive process, i.e. by drilling out the majority of the former and then breaking up and brushing out the residue.

As previously mentioned, the engagement of the molten hard facing material with the periphery of the former may result in some slight eating away of the surface of the former. In order to compensate for this, the portion of the former 21 which projects from the socket 20 and beyond the surface 22 of the blade 13 may be of slightly greater diameter than the socket so that the effect of the eating away or erosion by the molten hard facing material is to reduce the diameter of the projecting portion to that of the socket 20.

The precise nature of the cutting structure which is to be fitted in the socket in the bit body does not form a part of the present invention, and the method may be employed in relation to virtually any form of cutting structure which is designed to be received in a socket in the bit body. However, for the purposes of illustration FIGS. 6 and 7 show typical cutting structures which may be employed.

Figure 6:
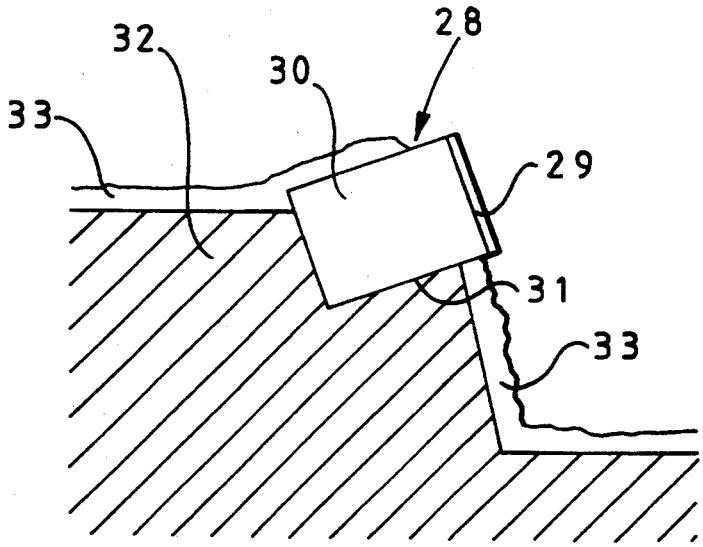
FIGS. 6 and 7 are diagrammatic sections through typical cutting structures, fitted to a bit body which has been hard faced by the method according to the invention.

In FIG. 6 the cutting structure 28 is of circular cross-section cylindrical shape and comprises a thin polycrystalline diamond cutting table 29 bonded to a substrate 30 of cemented tungsten carbide. The substrate 30 is directly brazed into a socket 31 formed in an upstanding blade 32 on the bit body, without first being bonded to a carrier. The surface of the blade 32 is hard faced, as indicated at 33, by the method previously described, the socket being filled by a carbon former, corresponding in shape to the cutting structure, while the hard facing is applied. According to the invention, the former is directly heated while the application of the hard facing is taking place, so that the hard facing material wets the surface of the former.

Figure 7:
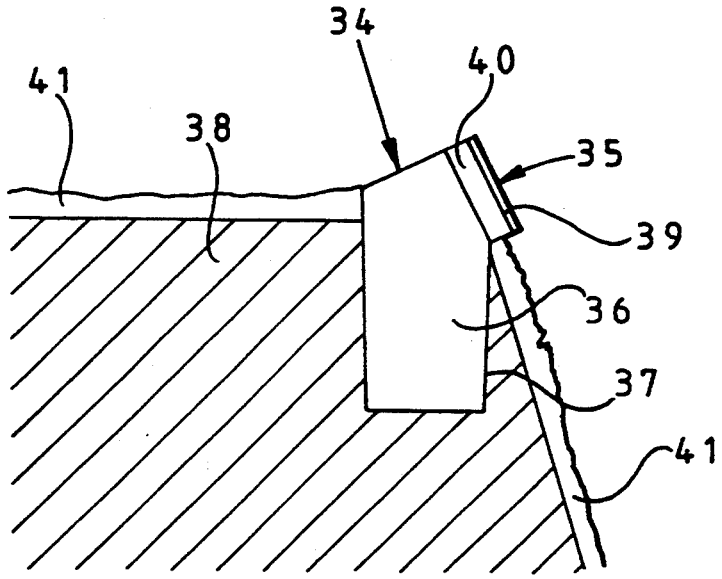

In the arrangement of FIG. 7, the cutting structure 34 comprises a preform cutting element 35 bonded to a tungsten carbide post 36 which is received in a socket 37 formed in an upstanding blade 38 on the bit body. The cutting element 35, in known manner, comprises a polycrystalline diamond cutting table 39 bonded to a tungsten carbide substrate 40, the rear surface of which is bonded to a suitably inclined surface on the post 36. Again, an appropriately shaped carbon former is positioned in the socket 37, and heated, while the hard facing 41 is applied.

I claim:

1. A method of manufacturing a rotary drill bit including the steps of forming a bit body part with a plurality of sockets, inserting in each of said sockets a carbon former which substantially fills at least the mouth of the socket and projects beyond the outer surface of the bit body part, applying a fusible hard facing material to the surface of the bit body part, at least in an area surrounding each said socket, by the localised application of heat to the material when solid so as to cause it to melt and weld to the surface of the bit body part, heating each former by the application of heat directly to the former, during the application of the hard facing material, so as to raise the temperature of the former to a level greater than the temperature to which it would otherwise be raised solely by conduction of heat from the hard facing material, and then removing the formers from the sockets.

2. A method according to claim 1, wherein each former is heated to a temperature between 750° C. and the melting temperature of the hard facing material.

3. A method according to claim 1, wherein each former is heated to a temperature which is within 200° C. of the melting temperature of the hard facing material.

4. A method according to claim 1, wherein the former is heated by intermittently applying to the former the same heat source which is used to melt the hard facing material.

5. A method according to claim 4, wherein the heat source is selected from a tungsten-inert gas welding arc or oxyacetylene torch.

6. A method according to claim 1, wherein the deposited hard facing material consists of approximately 65% fused tungsten carbide grains in a 35% Ni—Cr—B—Si alloy matrix.

7. A method according to claim 1, wherein the cross-dimensions of the portion of each former which projects from its socket are slightly greater than the corresponding dimensions of the socket itself, so as to compensate for erosion of the surface of the projecting portion by the molten hard facing material which engages it.

8. A method according to claim 7, wherein the sockets and former are circular in cross-section, the projecting portion of the former being of slightly greater diameter than the socket.

9. A drill bit when partly manufactured by the method according to claim 1.

* * * * *